US006358117B1

(12) United States Patent
Kato et al.

(10) Patent No.: US 6,358,117 B1
(45) Date of Patent: Mar. 19, 2002

(54) PROCESSING METHOD FOR A WAFER

(75) Inventors: Tadahiro Kato, Fukushima; Hisashi Oshima, Niigata; Keiichi Okabe, Kosyoku, all of (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 0 days.

(21) Appl. No.: 09/441,783

(22) Filed: Nov. 17, 1999

(30) Foreign Application Priority Data

Nov. 26, 1998 (JP) ..... 10-335737

(51) Int. Cl.[7] ..... B24B 49/00

(52) U.S. Cl. ..... 451/8; 451/41; 451/42; 451/58; 451/158; 451/283; 451/285

(58) Field of Search ..... 451/41, 8, 42, 451/57, 58, 158, 159, 160, 283, 285, 287

(56) References Cited

U.S. PATENT DOCUMENTS 3,905,162 A * 9/1975 Lawrence et al. ..... 451/283
4,106,915 A * 8/1978 Kagawa et al. ..... 451/283
5,888,838 A * 3/1999 Mendelson et al. ..... 438/15

* cited by examiner

*Primary Examiner*—M. Rachuba
(74) *Attorney, Agent, or Firm*—Arent Fox Kintner Ploitkin & Kahn, PLLC

(57) ABSTRACT

A surface grinding method is provided by which grinding striations are produced so that the striations can fully be removed by a polish-off amount less than required in a conventional way in mirror polishing following surface grinding using an infeed type surface grinder, in which two circular tables, opposite to each other, which are driven and rotate independently from each other, are arranged so that the peripheral end portion of one table coincides with an axial center of a rotary shaft of the other table all time, the two circular tables being located so as to be shifted sideways from each other; not only is a grinding stone held fixedly on an opposite surface of the one table, but the wafer is fixed on an opposite surface of the other table; the two tables are rotated relatively to each other; and at least one table is pressed on the other while at least one table is relatively moved in a direction, so that a surface of the wafer is ground, wherein the surface of the wafer is ground while controlling a pitch of grinding striations produced across all the surface of the wafer processed by the grinding stone to be 1.6 mm or less.

12 Claims, 3 Drawing Sheets

PROCESSING METHOD FOR A WAFER

BACKGROUND OF THE INVENTION

1. Field of the Invention

The present invention relates to a surface grinding method and a mirror polishing method for a thin plate such as a semiconductor silicon wafer (hereinafter also simply referred to as wafer) by an infeed type surface grinder.

2. Description of Related Art

In semiconductor wafer processing, a method has heretofore been adopted in which after a sliced wafer is chamfered along its peripheral portion, the sliced wafer is further subjected to lapping and etching in the order and thereafter, a surface thereof is mirror-polished.

While, in the etching step, generally a total of about 40 $\mu$m has been removed on both surfaces in order to eliminate a work damage caused by lapping, the etching is a cause to reduce a flatness of a wafer in the final stage, in which mirror polishing is applied, since a flatness of a wafer is degraded by the etching.

Hence, in recent years, surface grinding has been adopted instead of lapping or after the etching in order to correct a flatness. Since, in surface grinding, there arises no work damage as deep as in lapping, a surface-ground wafer can be polished directly without any etching or only after very light etching, which amounts to a removal, for example, of 4 to 5 $\mu$m in total on both surface. Therefore, adoption of surface grinding has an advantage to improve a wafer flatness, as compared with a conventional way.

In a case where a thin disc such as a semiconductor wafer is surface-ground, an infeed type surface grinder 12 as shown in FIG. 1 has very recently been employed. The surface grinder 12, which will be detailed later, has a construction and operating relations between constituents such that two circular tables 14 an 16, opposite to each other and one on the other, which are driven and rotate independently from each other, are arranged so that the peripheral end portion 18 of an upper table 14 coincides with the axial center 20*a* of a rotary shaft 20 of a lower table 16 all time, the two circular tables 14 and 16 being located so as to be shifted sideways from each other; not only is a grinding stone 22 held fixedly on a lower surface of the upper table 14, but a wafer (W) is fixed on an upper surface of the lower table 16; the tables 14 and 16 arranged one on the other are rotated relatively to each other; and at least one table is pressed on the other while at least one table is moved in a vertical direction, so that a surface of the wafer (W) is ground.

In a case where an infeed type surface grinder 12 as described above is adopted, there arises generally some error in parallelism between a rotary shaft 24 of the upper table and the rotary shaft 20 of the lower table and for this reason, trails only in an upper half surface or a lower half surface of the grinding stone 22 are observed on a ground surface of the wafer (W) at a constant pitch (e) in the form of grinding striations 26 comprising recesses and protrusions. The pitch (e) of the grinding striations 26 changes according to grinding conditions so as to be large (FIG. 2A) or small (FIG. 2B).

There has been a problem in connection with the surface grinding, since the grinding striations 26 cannot be removed in a mirror polishing, following the surface grinding, in which a regular stock removal of 10 $\mu$m is effected and it is necessary to polish off a surface portion of the wafer by 20 to 30 $\mu$m on one surface in order to fully eliminate the striations 26.

It has been experienced that deep pits occur locally on surfaces of the wafer (W) in lapping and the pits cannot be removed even in etching, which requires polishing-off of the order of 10 $\mu$m. Since polishing-off of 10 $\mu$m or deeper not only reduces productivity of a polishing step but deteriorate a flatness, compared with a conventional process, such increase in removal of polishing-off has to be avoided.

The present inventors have conducted serious studies from various angles on a surface grinding method by which grinding striations remaining on surfaces of a wafer caused in surface grinding using an infeed type surface grinder are produced so as to be able to be removed by polishing-off of 10 $\mu$m or less and as a result, have acquired findings that there is a correlation between a pitch of grinding striations and a polishing-off depth to remove the striations and, in the course of further studies, that a polishing-off depth can be restricted to 10 $\mu$m or less regardless of a diameter of a wafer if a pitch of grinding striations is adjusted to a given value or less. The present invention has been made based on such findings.

SUMMARY OF THE INVENTION

It is an object of the present invention to provide a surface grinding method by which grinding striations are produced so that the striations can fully be removed by a polish-off amount less than required in a conventional way in mirror polishing following surface grinding using an infeed type surface grinder.

In order to solve the above described problem, a surface grinding method of the present invention is directed to a surface grinding method for a wafer in which two circular tables, opposite to each other, which are driven and rotate independently from each other, are arranged so that the peripheral end portion of one table coincides with the axial center of a rotary shaft of the other table all time, the two circular tables being located so as to be shifted sideways from each other; not only is a grinding stone held fixedly on an opposite surface of the one table, but the wafer is fixed on an opposite surface of the other table; the two tables are rotated relatively to each other; and at least one table is pressed on the other while at least one table is relatively moved in a direction, so that a surface of the wafer is ground, wherein the surface of the wafer is ground while controlling a pitch of grinding striations produced across all the surface of the wafer processed by the grinding stone to be 1.6 mm or less.

A resinoid grinding stone that has some elasticity is preferred as a grinding stone held fixedly on the opposite surface of the one table. A number of the grinding stone is preferred to be of a fine grain size of #2000 or higher.

In order to control a pitch of the grinding striations to be 1.6 mm or less, the following two ways can be selected; a rotation number of a wafer in spark-out is adjusted or a rotation number of a wafer and a returning speed in escape are adjusted.

An additional way for the control of a pitch of the grinding striations is possibly adopted in which a rotation number (rotation rate) of the wafer during at least one rotation of the wafer just before a grinding stone in escape moves away from the wafer is adjusted.

A mirror polishing method for a wafer of the present invention is characterized by that a wafer that has been surface-ground by the above described surface grinding method receives mirror polishing. With this mirror polishing method for a wafer, there can be obtained a mirror polished wafer from which grinding striations are fully removed by a polishing-off amount less than in a conventional way.

The reason why a difference in polishing-off amount arises according to a pitch of grinding striations is considered to be that when a pitch of grinding striations is large, a polishing pad 30 is put into contact with a wafer surface so that the pad 30 covers closely along a surface contour of recesses and protrusions constituting grinding striations, as shown in FIG. 3A and thereby, the recesses and protrusions are hard to be erased, whereas when the pitch is small, the polishing pad is put into closer contact with the protrusions than with the recesses, as shown in FIG. 3B, which enables the surface contour to be flattened with ease. Based on such an estimated mechanism for flattening, a polishing-off amount can be reduced regardless of a diameter of a wafer by controlling a pitch of grinding striations to be equal to or smaller than a specific value.

A value of a pitch of grinding striations can be expressed by a formula: $2\pi r/[(\text{a rotation number of a grinding stone})/(\text{a rotation number of a wafer})]$, wherein r indicates a wafer radius. Therefore, to control a pitch of grinding striations to be 1.6 mm or less can be realized by controlling a rotation number of a grinding stone or a rotation number of a wafer.

Since a grinding stone, however, rotates at a high speed, to control the rotation number is likely very difficult from a mechanical viewpoint and therefore, it is preferred to control the pitch by a rotation number of a wafer.

On the other hand, if a returning speed in escape is small (for example, 0.01 $\mu$m/sec or less) when an elastic grinding stone is used, an effect similar to that in spark-out can be obtained since the grinding stone is kept in contact with a wafer for a time.

Spark-out means a state in which a grinding stone and a wafer are both rotating after grinding-off of a given amount is completed and a feed of a grinding stone is ceased and escape means to move a grinding stone in a direction in which the grinding stone moves away from the wafer, the grinding stone and the wafer previously being in a state of spark-out.

As described above, according to the present invention, in surface grinding using a surface grinder, when a pitch of grinding striations in the peripheral portion of a wafer is adjusted to be a given value or less, grinding striations on a wafer surface can fully be eliminated by a polish-off amount less than in a conventional way, which can achieve a great effect enabling increase in productivity and improvement of a wafer flatness to be realized.

BRIEF DESCRIPTION OF THE DRAWINGS

FIG. 2A shows grinding striations at a large pitch and FIG. 2B shows grinding striations at a small pitch; FIG. 3A shows a case of a large pitch of grinding striations and FIG. 3B shows a case of a small pitch of grinding striations.

DETAILED DESCRIPTION OF THE INVENTION

Description will below be made of one example of an infeed type surface grinder employed in a method of the present invention with reference to FIG. 1.

Figure 1:
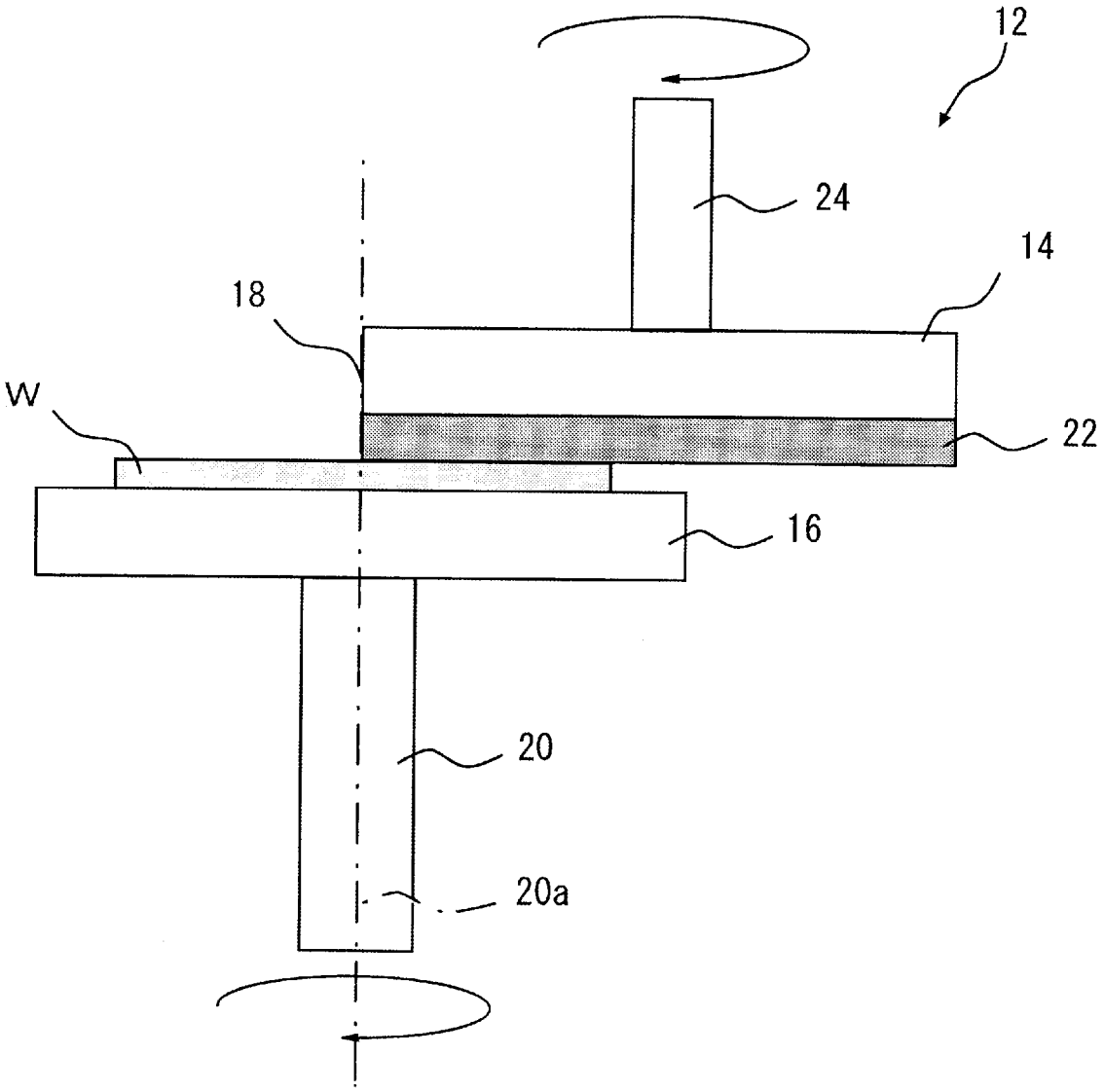
FIG. 1 is a schematic side view illustrating one example of an infeed type surface grinder.
Figure 2A:
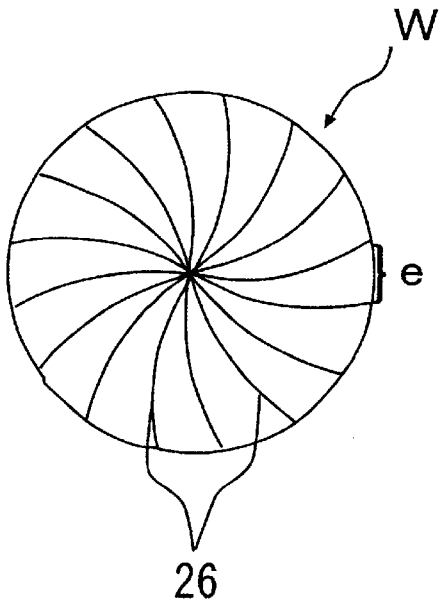
FIGS. 2A and 2B are schematic plan views showing grinding striations observed on a ground surface of a wafer which has received surface grinding by an infeed type surface grinder.
Figure 2B:
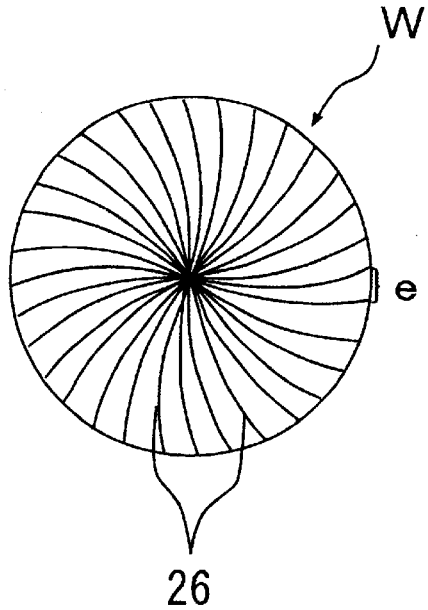
Figure 3A:
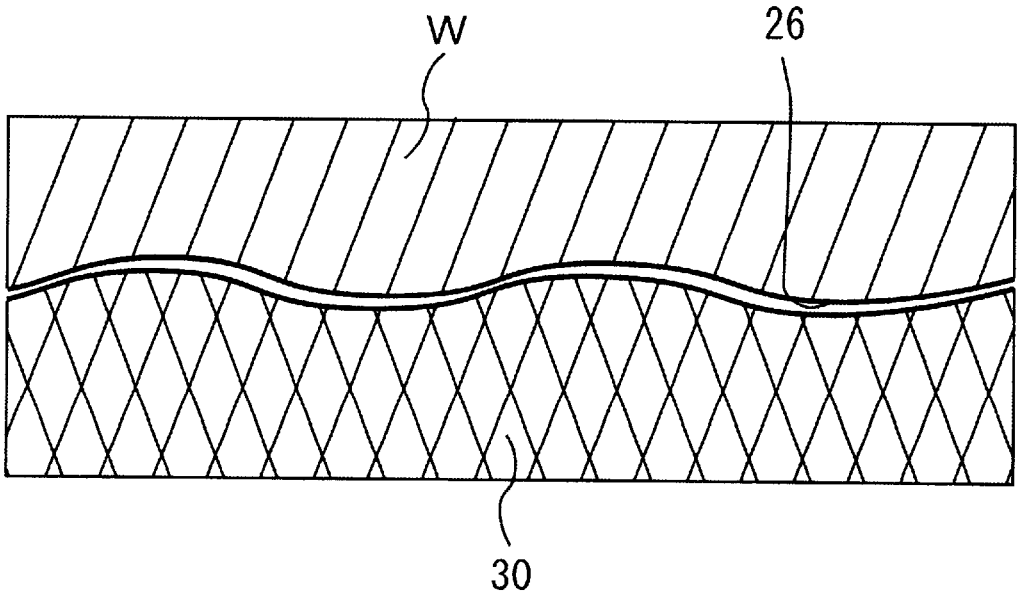
FIGS. 3A and 3B are sectional side views illustrating a contact state between a ground surface of a wafer and a polishing pad when the ground surface of the wafer processed by surface-grinding is mirror-polished.
Figure 3B:
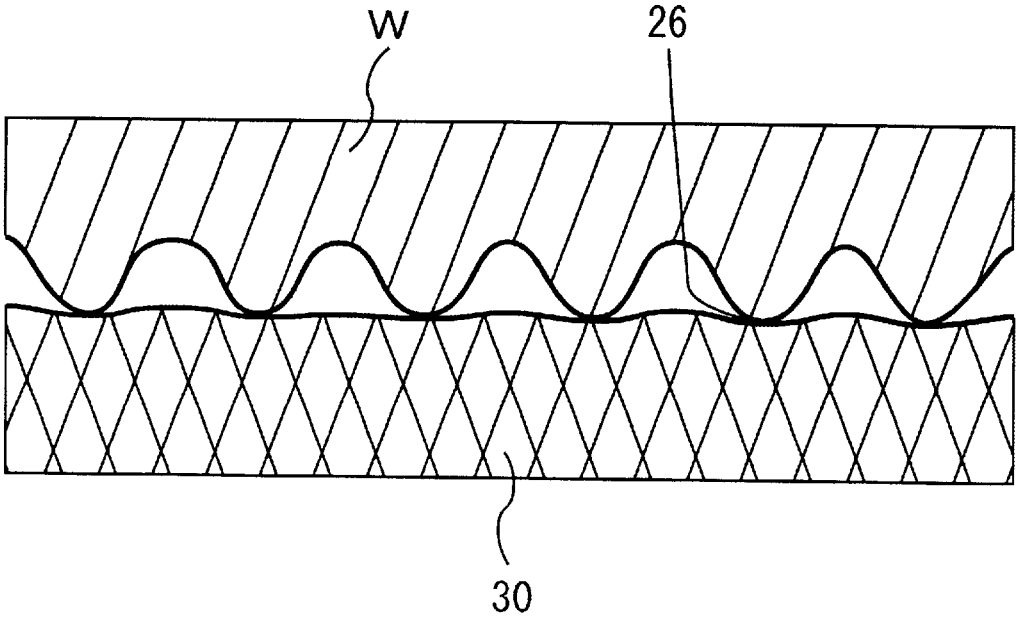

In FIG. 1, 12 indicates an infeed type surface grinder and the surface grinder 12 has two circular tables 14 and 16 opposite to each other, which are driven and rotate independently from each other. A direction in which the two circular tables 14 and 16 face each other may be any of one on the other, left to right, oblique and other directions as far as the two circular tables 14 and 16 are arranged opposite to each other. In FIG. 1, since there is shown an example in which the two circular tables 14 and 16 are opposite to each other and one on the other, the opposite two circular tables 14 and 16 are respectively referred to as an upper table 14 and a lower table 16 in the description below.

While the upper and lower tables 14 and 16 are arranged in a direction of one on the other in an opposite manner to each other, the two tables 14 and 16 are shifted sideways from each other so that the peripheral edge portion 18 of the upper table 14 coincides with an axial center 20*a* of a rotary shaft 20 of the lower table 16 all time.

A grinding stone 22 is held on a lower surface of the lower table 14. A vacuum suction mechanism (not shown) which can fixedly suck the wafer (W) is provided on an upper surface of the lower table 16. A wafer (W) to be ground is fixed on the upper surface of the lower table 16 by the vacuum suction mechanism. A numerical mark 24 indicates a rotary shaft of the upper table 14.

The tables 14 and 16, one on the other, are rotated and at least one table is pressed on the other table, moving in a vertical direction, whereby a surface of the wafer (W) that is fixed on the upper surface of the lower table 16 is ground.

As a grinding stone, a resinoid grinding stone is preferred. A resinoid grinding stone has a slight elasticity and the grinding stone itself shrinks by a small amount under the pressure in grinding with the result that good grinding is achieved.

Besides, in order to reduce a damage in grinding, a grain size number of the grinding stone 22 is preferably of a fine grain size of #2000 or higher.

While a surface grinding method of the present invention is preferably used for semiconductor silicon wafer processing, a process in the case comprises, for example, a slicing step, a chamfering step, a lapping step, an etching step, a single-side surface grinding step (a surface grinding method of the present invention is applied), a double-side mirror polishing step, and a single-side mirror polishing step, wherein the steps are performed in the order. Of course, it is needless to say that, after the surface grinding step, an etching step may be adopted, in which etching being effected to a level at which a shape of the wafer is still kept as it was, and a mirror polishing of chamfered edge may also be conducted.

A procedure to effect grinding using the surface grinder 12 comprises the following steps:

(1) A wafer (W) is fixed on the lower table 16 by vacuum suction, while the tables 14 and 16, one above the other, are separated from each other.

(2) The wafer (W) is ground by gradually moving the upper table 14 downward while rotating. During the downward movement, the wafer (W) is simultaneously kept rotated. Herein, grinding conditions are set so that a rotation number of the grinding stone 22 is 4800 rpm, a rotation number of the wafer (W) is 20 rpm and a descending speed (a feed rate) of the grinding stone 22 is of the order of 0.3 $\mu$m/sec.

(3) The downward movement of the grinding stone 22 is ceased when the wafer (W) is ground off by 10 $\mu$m, while the grinding stone 20 and the wafer (W) continues to rotate as they are, which state is referred to as spark-out.

(4) The grinding stone 22 is gradually moved upward, which state is referred to as escape.

(5) The grinding stone 22 is stopped when it moves up to an original position and the grinding stone 22 and the wafer (W) are simultaneously stopped in terms of their rotation.

(6) Vacuum suction for the wafer (W) is broken and the wafer (W) is taken out.

EXAMPLES

Then, while description will be made of the present invention using examples, it is needless to say that the present invention is not limited to the examples.

Example 1

Etched wafers of 6", 8" and 12" received surface grinding with the surface grinder 12 and thereafter, received mirror-polishing with a double-side mirror polisher, wherein other grinding conditions were as follows: 3 wafers of each diameter were subjected to surface grinding of each of wafer rotation numbers of 20 (a normal condition), 18, 16, 14, 12, 10, 8 and 6 rpm during a period from spark-out to escape and all wafers provided in experiments were processed under common conditions: a rotation number of a grinding stone is 4800 rpm, a descending speed of the grinding stone (a feed rate) is 0.3 $\mu$m/sec, a material of the grinding stone is a resin #2000 made by Disco Corporation and a grinding stock removal is 10 $\mu$m; and other polishing condition was that 20 $\mu$m in total was polished off on both sides of all the wafers provided in the experiments.

As related other conditions, a polishing pad used in double-side polishing by the double-side mirror polisher was SUBA-600 (made by Rodel Nitta Company) and a polishing agent used in double-side polishing was AJ-1325 (made by Nissan Chemical Industries, Ltd.).

A pitch of grinding striations remaining on a surface in the peripheral portion of a wafer after surface grinding is expressed by a following formula (1):

$$\text{A striation pitch} = 2\pi r/[(\text{a rotation number of a grinding stone})/(\text{a rotation number of a wafer})] \quad (1),$$

wherein r indicates a wafer radius.

The wafers subjected to double-side mirror polishing were observed using a magic mirror to investigate on whether or not a striation is existent. Results are shown in Table 1.

In Table 1, ○ in columns of Polish-off 20 $\mu$m indicates that no grinding striation remains and x indicates in columns of polish-off 20 $\mu$m indicates that a grinding striation or grinding striations are observed.

It is found from the results of Table 1 that when a pitch of grinding striations was controlled to be 1.6 mm or less, all wafers were free from grinding striations after mirror polishing by a polish-off of 20 $\mu$m in total on both sides (10 $\mu$m on one side) regardless of a diameter of a wafer.

Example 2

The rotation number of a wafer in spark-out is kept as 20 rpm, same as in Example 1 and with the exception in spark-out, totally the same experiments were conducted while a rotation number of a wafer in escape was changed in the same way as described above. An ascending speed (a returning speed) of a grinding stone in escape was varied in two ways: a low speed of 0.01 $\mu$m/sec and a high speed of 0.3 $\mu$m/sec.

As a result, when the ascending speed (returning speed) is set to a low speed, results similar to the experiments in which a rotation number of a wafer in the spark-out was changed were obtained, but when the ascending speed (a returning speed) is set to a high speed, grinding striations remained on all processed wafers after mirror polishing.

The reason why is considered to be that, since a grinding stone in use is a resinoid grinding stone (resin #2000), the grinding stone itself is in a compressed state to some extent during grinding due to its elasticity and, when an ascending speed (a returning speed) of the grinding stone is slow in escape, grinding striations are produced at a pitch corresponding to a rotation number of a wafer in the escape since the grinding stone is kept in contact with the wafer for a time before separation.

In this case, it is required that an ascending speed (a returning speed) of a grinding stone is adjusted to be slow enough for the grinding stone and the wafer to be kept in contact with each other at least for one rotation of the wafer and the ascending speed is considered to change depending to an elasticity of the grinding stone. While, if a grinding stone with a large elasticity is used, grinding striations are formed at a pitch corresponding to a rotation number of a wafer in escape even when a comparatively high ascending speed (returning speed) is adopted, if a hard grinding stone is used, grinding striations corresponding to a rotation of a wafer in spark-out remain even when a considerably small speed is adopted.

TABLE 1

| Diameter | 150 mm | | 200 mm | | 300 mm | |
|---|---|---|---|---|---|---|
| Rotation No. in spark-out (rpm) | Striation pitch (mm) | Polish-off 20 $\mu$m | Striation pitch (mm) | Polish-off 20 $\mu$m | Striation pitch (mm) | Polish-off 20 $\mu$m |
| 20 | 1.96 | x | 2.62 | x | 3.93 | x |
| 18 | 1.77 | x | 2.36 | x | 3.53 | x |
| 16 | 1.57 | ○ | 2.09 | x | 3.14 | x |
| 14 | 1.37 | ○ | 1.83 | x | 2.75 | x |
| 12 | 1.18 | ○ | 1.57 | ○ | 2.36 | x |
| 10 | 0.98 | ○ | 1.31 | ○ | 1.96 | x |
| 8 | 0.79 | ○ | 1.05 | ○ | 1.57 | ○ |
| 6 | 0.59 | ○ | 0.79 | ○ | 1.18 | ○ |

When a high ascending speed (a returning speed) is adopted, the grinding stone is moved away from a wafer directly after starting the upward-movement and therefore, striations produced in spark-out are considered to remain as they were.

Obviously various minor changes and modifications of the present invention are possible in the light of the above teaching. It is therefore to be understood that within the scope of the appended claims the invention may be practiced otherwise than as specifically described.

What is claimed is:

1. A processing method for a wafer, having two circular tables, opposite to and independent of each other, are arranged so that the peripheral end portion of one table coincides with an axial center of a rotary shaft of the other table at all times, comprising the steps of:

fixing a grinding stone on an opposite surface of the one table, fixing the wafer on an opposite surface of the other table;

rotating the two tables independently relative to each other; and pressing at least one table on the other while said at least one table is relatively moved in a direction, so that a surface of the wafer is ground, wherein the surface of the wafer is ground while controlling a pitch of grinding striations produced across all the surface of the wafer processed by the grinding stone to be 1.6 mm or less.

2. A processing method for a wafer according to claim 1, further comprising the step of providing the grinding stone which is a resinoid grinding stone.

3. A processing method for a wafer according to claim 1, further comprising the step of controlling a pitch of the grinding striations by adjusting a rotation number of the wafer in spark-out.

4. A processing method for a wafer according to claim 1, further comprising the step of controlling a pitch of the grinding striations by adjusting a rotation number of the wafer and a returning speed in escape.

5. A processing method for a wafer according to claim 1, further comprising the step of controlling a pitch of the grinding striations by adjusting a rotation number of the wafer during at least one rotation of the wafer just before the grinding stone in escape moves away from the wafer.

6. A processing method for a wafer according to claim 4, further comprising the step of controlling a pitch of the grinding striations by adjusting a rotation number of the wafer during at least one rotation of the wafer just before the grinding stone in escape moves away from the wafer.

7. A processing method for a wafer according to claim 1, further comprising the step of mirror polishing the wafer.

8. A processing method for a wafer according to claim 2, further comprising the step of mirror polishing the wafer.

9. A processing method for a wafer according to claim 5, further comprising the step of mirror polishing the wafer.

10. A processing method for a wafer according to claim 6, further comprising the step of mirror polishing the wafer.

11. A processing method for a wafer according to claim 7, further comprising the step of mirror polishing the wafer.

12. A processing method for a wafer according to claim 8, further comprising the step of mirror polishing the wafer.

* * * * *